United States Patent [19]

Noguchi

[11] 4,316,125

[45] Feb. 16, 1982

[54] POWER SUPPLY FOR A FLASH TUBE

[75] Inventor: Koichi Noguchi, Tokyo, Japan

[73] Assignee: Ricoh Company, Ltd., Tokyo, Japan

[21] Appl. No.: 87,601

[22] Filed: Oct. 18, 1979

[30] Foreign Application Priority Data

Oct. 18, 1978 [JP] Japan ..... 53-128017

[51] Int. Cl.[3] ..... H05B 41/30

[52] U.S. Cl. ..... 315/241 R; 315/205; 315/247; 323/207; 363/4; 363/86

[58] Field of Search ..... 363/44, 45, 48, 49, 363/53, 54, 59–61, 67–69, 86, 4; 315/205, 247, 241 R; 355/69; 323/207

[56] References Cited

U.S. PATENT DOCUMENTS 2,356,558 8/1944 Bähring ..... 363/67

3,646,423 2/1972 Tatematsu et al. ..... 363/54

4,045,708 8/1977 Neal ..... 363/68

4,187,449 2/1980 Knoble ..... 315/205

*Primary Examiner*—William H. Beha, Jr.

*Attorney, Agent, or Firm*—David G. Alexander

[57] ABSTRACT

First and second rectifiers (37), (41) have inputs connected to an A.C. power source (12) through a unitary switch (33) and outputs connected to first and second smoothing filters (38), (42) respectively. An inductance (39) is connected between the switch (33) and the first rectifier (37) whereas a capacitance (43) is connected between the switch (33) and the second rectifier (41). The values of the inductance (39) and capacitance (43) are selected in such a manner that surge currents through the capacitance (43) and inductance (39) occuring when the switch (33) is closed are limited and the power factor of the power supply (31) is maximized.

6 Claims, 8 Drawing Figures

POWER SUPPLY FOR A FLASH TUBE

BACKGROUND OF THE INVENTION

The present invention relates to a power supply for converting A.C. to D.C. and is especially useful for driving a flash lamp used to illuminate an original document in an electrostatic copying machine.

In an electrostatic copying machine a light image is radiated onto a charged, photoconductive member to form an electrostatic image which is developed and transferred to a copy sheet to provide a permanent copy. Various copying machines have been developed which use as the photoconductive member an endless belt which has flat runs. The belt configuration allows the entire light image to be radiated onto the belt at one time as opposed to slit exposure used in copying machines having photoconductive drums.

Since it is undesirable to stop the belt and hold it stationary during exposure, since this would lower the copying speed, illumination of the original document for exposure is performed by a flash lamp or tube which provides an intense flash of light for a very short duration. This has the effect of freezing the image relative to the belt and making it possible to expose the belt while it is moving at constant speed.

The power supply used to drive the flash tube generally comprises a step-up transformer to provide a high A.C. output from standard line voltage, a rectifier for converting the output of the transformer into pulsating D.C. and a filter capacitor for smoothing and storing the pulsating D.C. to produce approximately constant D.C. for application to the flash tube. A switch connected between the A.C. line power source and the transformer opens when the voltage across the flash tube reaches a predetermined high value to prevent applying an excessively high voltage to the flash tube. At the desired time, a signal is applied to a trigger electrode of the flash tube which causes the capacitor to discharge through the tube, which fires and emits light.

Upon firing of the tube, the voltage across the capacitor drops to substantially zero and the switch is closed to recharge the capacitor. At the time the switch is closed a very high surge current flows through the various elements of the power supply. If no means are provided to limit the surge current, the transformer, rectifier, capacitor, switch etc. must have excessively large current capacities to withstand the surge current. Such high current components are undesirable from the standpoints of size and cost.

It has been known to provide a current limiting element between the switch and the rectifier, such as between the transformer and the rectifier. The limiting element may be a resistor, capacitor or inductor. The resistor does not affect the power factor of the power supply but dissipates current at all times and produces heat. This constitutes a waste of energy and requires that the transformer provide increased step-up voltage and current to compensate for the loss.

Inductors and capacitors do not actually dissipate power but introduce a phase shift into the power supply which substantially reduces the power factor. The reduced power factor means that the various components of the power supply must have an unnecessarily large apparent power (volt-ampere product) capacity since the voltage and current have been shifted out of phase by the current limiting capacitor or inductor.

SUMMARY OF THE INVENTION

A power supply embodying the present invention comprises first rectifier means, first smoothing filter means connected to an output of the first rectifier means, second rectifier means, second smoothing filter means connected to an output of the second rectifier means, switch means for connecting the first and second rectifier means to an A.C. power source in a unitary manner, a current limiting inductance means connected between the switch means and the first rectifier means and a current limiting capacitance means connected between the switch means and the second rectifier means, an inductance of the inductance means and a capacitance of the capacitance means being selected to maximize a power factor of the power supply.

In accordance with the present invention, first and second rectifiers have inputs connected to an A.C. power source through a unitary switch and outputs connected to first and second smoothing filters respectively. An inductance is connected between the switch and the first rectifier whereas a capacitance is connected between the switch and the second rectifier. The values of the inductance and capacitance are selected in such a manner that surge currents through the capacitance and inductance occuring when the switch is closed are limited and the power factor of the power supply is maximized.

It is an object of the present invention to provide an improved power supply comprising means for adjusting the power factor of the power supply to substantially unity.

It is another object of the present invention to provide an improved power supply comprising means for limiting surge current which do not introduce a phase shift which would result in increased apparent power.

It is another object of the present invention to provide an improved power supply comprising means for limiting surge current while simultaneously reducing apparent power.

It is another object of the present invention to produce a high output power supply comprising components of low power capacity and cost compared to the prior art.

It is another object of the present invention to provide a generally improved power supply.

Other objects, together with the foregoing, are attained in the embodiments described in the following description and illustrated in the accompanying drawing.

DESCRIPTION OF THE PREFERRED EMBODIMENTS

While the power supply of the present invention is susceptible of numerous physical embodiments, depending upon the environment and requirements of use, substantial numbers of the herein shown and described embodiments have been made, tested and used, and all have performed in an eminently satisfactory manner.

Figure 1:
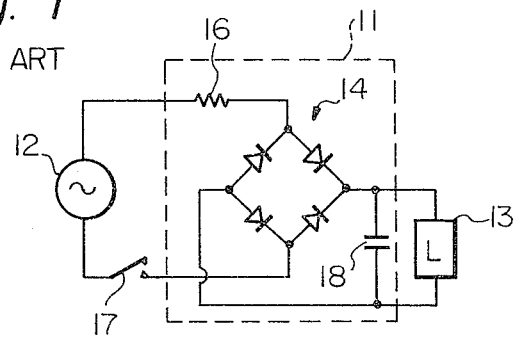
Fig. 1 PRIOR ART
FIGS. 1, 2 and 3 are electrical schematic diagrams of prior art power supplies.

Referring now to FIG. 1 of the drawing, a prior art power supply 11 is connected between an A.C. line power source 12 and a load 13. The power supply 11 comprises a bridge rectifier including four diodes connected in the well known bridge configuration which are collectively designated as 14. The rectifier 14 functions to full wave rectify the A.C. voltage from the source 12. A current limiting resistor 16 and a switch 17 are connected in series with the rectifier 14 and source 12. A smoothing filter capacitor 18 is connected in parallel with the load 13 across the output of the rectifier 14.

When the switch 17 is closed, current flows through the switch 17, resistor 16 and rectifier 14. The A.C. current from the source 12 is rectified by the rectifier 14 to produce pulsating D.C. current which charges the capacitor 18. The capacitor 18 functions as a filter to smooth out the peaks of the pulsating D.C. When the voltage across the capacitor 18 is substantially equal to the peak output voltage of the rectifier 14, the voltage across the capacitor 18 will have a constant value with a small ripple component.

When the switch 17 is initially closed, the voltage across the capacitor 18 is zero. In accordance with the time constant of the circuit, a very large initial surge current will flow through the rectifier 14 and capacitor 18 which will decrease with time as the capacitor 18 charges. The purpose of the resistor 16 is to limit this current to a value which will not damage the diodes in the rectifier 14. However, the electrical power dissipated by the resistor 16 is disadvantageous for the reasons discussed above.

Figure 2:
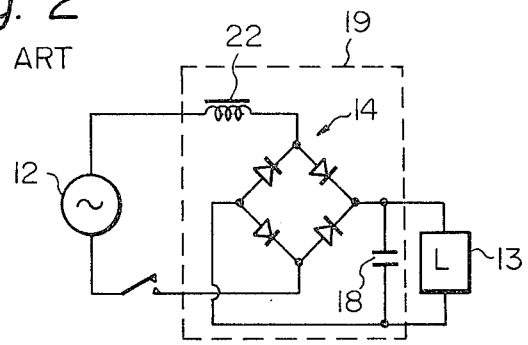
Fig. 2 PRIOR ART
Figure 3:
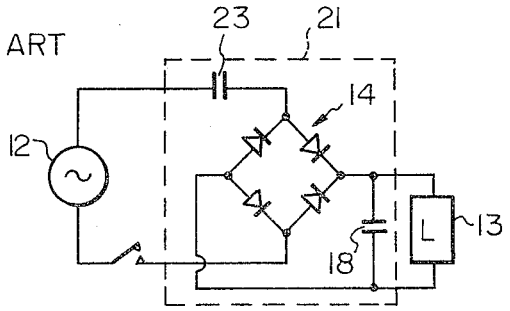
Fig. 3 PRIOR ART

FIGS. 2 and 3 illustrate power supplies 19 and 21 in which like elements are designated by the same reference numerals. The power supplies 19 and 21 differ from the power supply 11 only in that the resistor 16 is replaced by an inductor 22 and a capacitor 23 respectively. The reactance of the inductor 22 and capacitor 23 limit the initial surge current in a manner similar to the resistor 16 but without dissipating power through ohmic resistance. However, the inductor 22 and capacitor 23 introduce phase shifts between voltage and current which increase the apparent power in the circuits and reduce the power factor. The diodes in the rectifier 14 must have excessively large current capacities to withstand the increased apparent power without breakdown. More specifically, the inductor 22 shifts the current backward (delay) relative to the voltage whereas the capacitor 23 shifts the current forward (advance) relative to the voltage.

Figure 4:
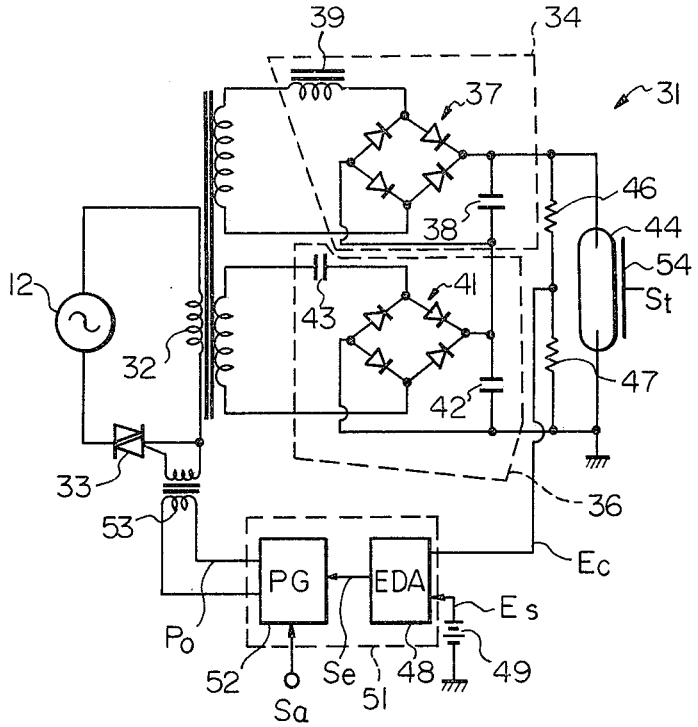
FIG. 4 is an electrical schematic diagram of a power supply embodying the present invention.

These problems are overcome in a novel and unique power supply 31 embodying the present invention which is illustrated in FIG. 4. The power source 12 is connected to the primary winding of a transformer 32 through a bidirectional thyristor or triac 33 which functions as a switch. The transformer 32 has two secondary windings which are connected to a first rectifier-filter unit 34 and a second rectifier-filter unit 36 respectively.

The unit 34 comprises a full-wave bridge rectifier 37 having an output connected to a smoothing filter capacitor 38. The input of the rectifier 37 is connected to the transformer 32 through a current limiting inductor 39. The unit 36 comprises a rectifier 41 connected between a smoothing filter capacitor 42 and a current limiting capacitor 43. The outputs of the units 34 and 36 are connected together in a voltage doubler configuration such that the voltage across the capacitor 42 is added to the voltage across the capacitor 38.

A flash tube 44 and a series combination of resistors 46 and 47 are connected across the series combination of the capacitors 38 and 42. The junction of the resistors 46 and 47 is connected to an input of an error detector amplifier 48 of a switch control unit 51. A reference voltage Es is applied to the amplifier 49 from a power source 49. The output of the amplifier 48 is connected to a pulse generator 52 which is constructed to feed pulses Po through a trigger transformer 53 to the gate of the triac 33.

In operation, the voltages across the capacitors 38 and 42 are initially zero. A switch (not shown) is closed to apply an ON signal Sa to the pulse generator 52. The voltage at the junction of the resistors 46 and 47, designated as Ec, is initially zero and thereby lower than the reference voltage Es. Under these conditions the amplifier 49, which typically comprises a comparator (not shown), produces a high switch signal Se. In response to the two high signals Sa and Se the pulse generator 52 is energized to generate and apply high frequency pulse signals Po to the triac 33 through the transformer 53. The triac 33 is turned on by the signals Po applied to the gate thereof and passes current from the source 12 to the transformer 32. Alternating current from the secondary windings of the transformer 32 is rectified by the rectifiers 37 and 41 and charges the capacitors 38 and 42 respectively.

Figure 5:
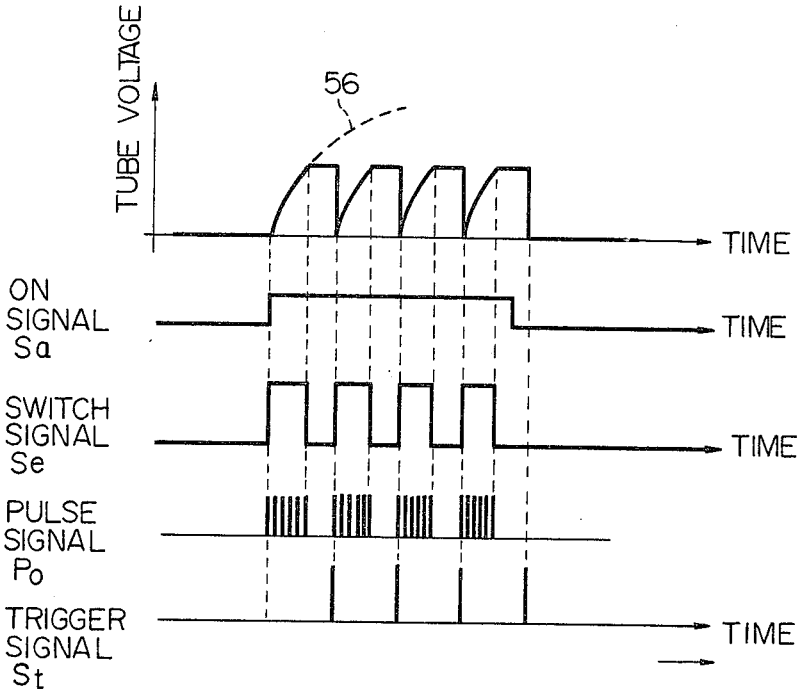
FIG. 5 is a timing diagram illustrating the operation of the power supply of FIG. 4.

With reference also being made to FIG. 5, as the capacitors 38 and 42 charge the voltage Ec rises. When Ec exceeds Es, the output Se of the amplifier 48 goes low and turns off the pulse generator 52. The triac 33 is turned off so that no current flows through the transformer 32. However, the capacitors 38 and 42 hold their charge.

The tube 44 is fired by applying a trigger signal St to a trigger electrode 54 thereof. The tube 44 emits an intense but brief flash of light for illuminating an original document or the like. The power for firing the tube 44 comes from the capacitors 38 and 42 which discharge through the tube 44. The capacitors 38 and 42 discharge down to substantially zero volts in a very short period of time and the voltage Ec thereby goes to zero. This causes the amplifier 48 to produce a high signal Se which energizes the generator 52 and results in turning on of the triac 33 for another charging operation.

The purpose of the inductor 39 and capacitor 43 is to limit current flow through the rectifiers 37 and 41 in the period shortly after the triac 33 is first turned on. It will be understood that at this time the capacitors 38 and 42 offer essentially no resistance to current flow which urges a high surge current to flow through the rectifiers 37 and 41. This surge current is resisted and limited by the reactances of the inductor 39 and capacitor 43.

As shown in FIG. 5, it is preferable to charge the capacitors 38 and 42 quickly. The voltage across the capacitors 38 and 42 depends on the time constant of the circuit but in general it may be considered that the voltage rises exponentially in such a manner that the rate of rise is very high initially and decreases with time. This is illustrated by a broken line curve 56 in FIG. 5. Although the capacitors 38 and 42 may be charged to a higher voltage, the voltage Es is selected to that the voltage Ec will be equal to Es in the early part of the charging operation of the capacitors 38 and 42. In other words, only the initial high charging rate or steep gradient portion of the curve 56 is used.

The inductor 39 introduces a current lag into the circuit whereas the capacitor 43 introduces a current lead. In accordance with an important feature of the present invention, the values of the inductor 39 and capacitor 43 are selected such that the lag introduced by the inductive reactance of the inductor 39 is equal to and cancels the lead introduced by the capacitive reactance of the capacitor 43. In this manner, the net phase shift is zero and the power factor of the power supply 31 is unity.

In this manner, the apparent power is equal to the actual power even though the inductor 39 and capacitor 43 function to limit the initial surge current. The power factor, as viewed from the source 12, is unity or a maximum value as close to unity as possible. This condition is achieved in accordance with the following equations $$N_1/N_2)^2\omega L=(N_1/N_3)^2\,(1/\omega C) \quad (1)$$

$$(1/\omega C)\,(N_2/N_3)^2=\omega L \quad (2)$$

where $\omega$ is the angular frequency of the power source 12, L is the inductance of the inductor 39, $\omega L$ is the inductive reactance of the inductor 39, C is the capacitance of the capacitor 43, $1/\omega C$ is the capacitive reactance of the capacitor 43, $N_1$ is the number of turns of the primary winding of the transformer 32, $N_2$ is the number of turns of the secondary winding of the transformer 32 which is connected to the inductor 39 and $N_3$ is the number of turns of the secondary winding of the transformer 32 which is connected to the capacitor 43. In general, the various parameters are selected to maximize the power factor of the power supply 31 as viewed from the source 12.

Figure 6:
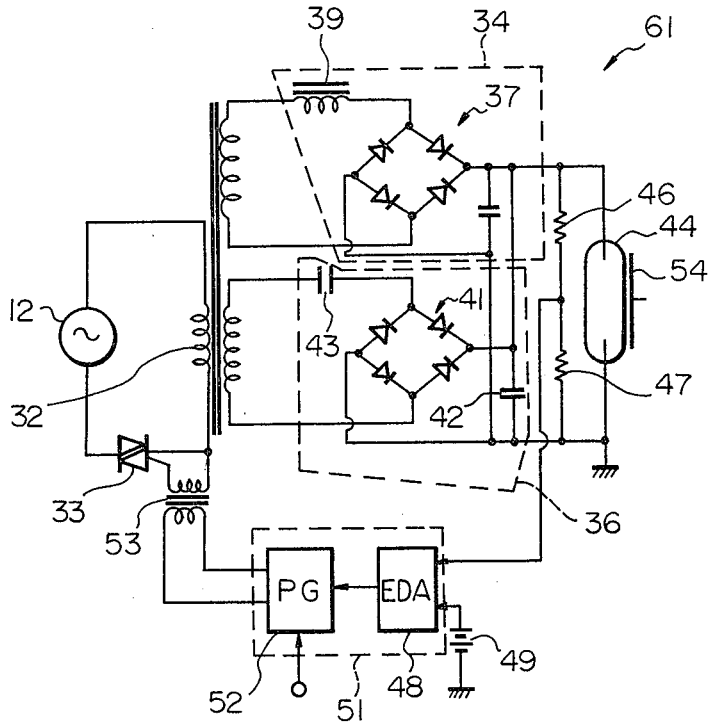
FIG. 6 is an electrical schematic diagram illustrating a modified form of the power supply of FIG. 4.

FIG. 6 illustrates another power supply embodying the present invention which is generally designated as 61. Like elements are designated by the same reference numerals. The difference between the power supply 61 and the power supply 31 is that in the power supply 61 the capacitors 38 and 42 are connected in parallel whereas in the power supply 31 the capacitors 38 and 42 are connected in series. The power supply 31 embodies a voltage doubler configuration whereas the power supply 61 embodies a current doubler configuration. The voltage across the capacitors 38 and 42 in FIG. 4 is the lowest of the output voltages of the rectifiers 37 and 41. Although not illustrated, it is further possible to completely disconnect the capacitors 38 and 42 from each other and connect them across separate loads such as flash tubes. It is also possible within the scope of the present invention to connect the capacitors 38 and 42 in the apparatus 31 across separate flash tubes.

Figure 7:
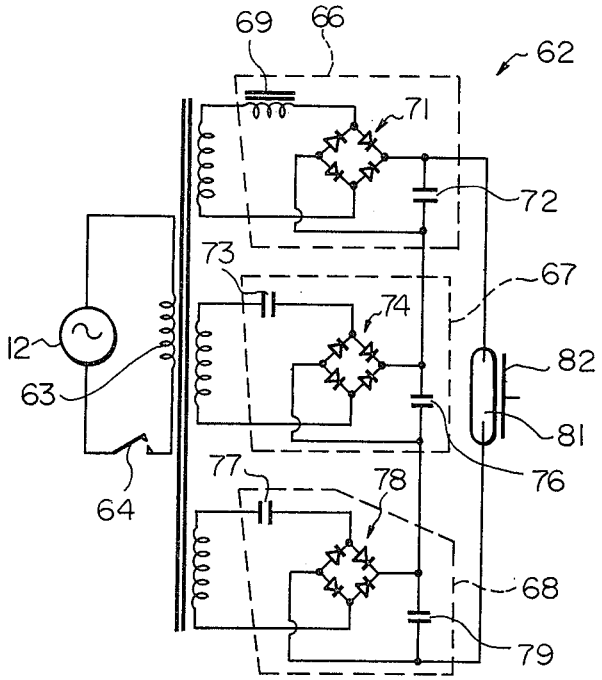
FIG. 7 is an electrical schematic diagram of another power supply embodying the present invention.

FIG. 7 illustrates another power supply 62 embodying the present invention which comprises a transformer 63 having a primary winding connected to the source 12 through a switch 64 which may be a triac or the like although not illustrated. The transformer 63 has three secondary windings connected to rectifier-filter units 66, 67 and 68 respectively. The unit 66 comprises an inductor 69 connected to a rectifier 71 and capacitor 72 in the same manner as in the previous embodiments. The unit 67 comprises a capacitor 73 connected to a rectifier 74 and capacitor 76. The unit 68 comprises a capacitor 77 connected to a rectifier 78 and capacitor 79. The capacitors 72, 76 and 79 are connected in series across a flash tube 81 which has a trigger electrode 82.

The inductor 69 and capacitors 73 and 77 function as current limiting elements in the manner described above. The values of the inductor 69 and capacitors 73 and 77 are selected in accordance with the following equation so that the power factor of the power supply 62 viewed from the source 12 is equal to unity.

$$\omega CaN_3^2+\omega CbN_4^2=N_2^2/\omega L \quad (3)$$

where Ca is the capacitance of the capacitor 73, $N_3$ is the number of turns of the secondary winding of the transformer 63 connected to the capacitor 73, Cb is the capacitance of the capacitor 77, $N_4$ is the number of turns of the secondary winding of the transformer 63 connected to the capacitor 77, L is the inductance of the inductor 69 and $N_2$ is the number of turns of the secondary winding of the transformer 63 connected to the inductor 59.

Figure 8:
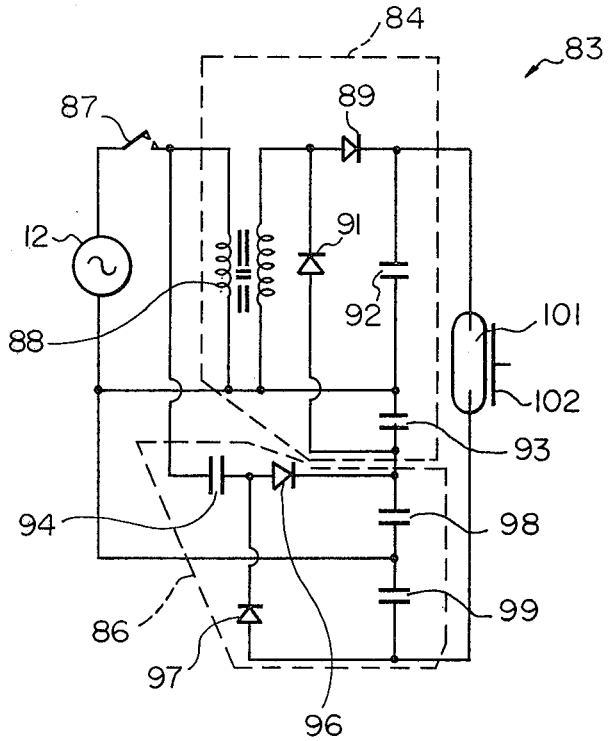
FIG. 8 is an electrical schematic diagram of yet another power supply embodying the present invention.

FIG. 8 illustrates another power supply 83 embodying the present invention which comprises a first rectifier-filter unit 84 and a second rectifier-filter unit 86 connected to the source 12 through a switch 87. The unit 84 comprises a leakage transformer 88 having a primary winding connected to the source 12 through the switch 87 and a secondary winding having one end connected to the anode of a diode 89 and the cathode of a diode 91. The cathode of the diode 89 is connected to a capacitor 92 whereas the anode of the diode 91 is connected to a capacitor 93. The capacitors 92 and 93 are connected together and the junction of the capacitors 92 and 93 is connected to the other end of the secondary winding of the transformer 88.

The unit 86 comprises a capacitor 94 connected between the switch 87 and the anode of a diode 96 which is connected to the cathode of a diode 97. The cathode of the diode 96 is connected to the junction of the capacitor 93 and a capacitor 98. The anode of the diode 97 is connected to a capacitor 99 which is connected to the capacitor 98. The junction of the capacitors 98 and 99 is connected to the junction of the source 12 and the primary winding of the transformer 88. A flash tube 101 having a trigger electrode 102 is connected across the capacitors 92, 93, 98 and 99.

The diodes 89 and 91 function to full wave rectify the voltage across the secondary winding of the transformer 88 and are connected to the capacitors 92 and 93 in a voltage doubler configuration. The diodes 96 and 97 full wave rectify the voltage across the source 12 and are connected to the capacitors 98 and 99 in a voltage doubler configuration. In addition, the outputs of the units 84 and 86 are connected together in a voltage doubler configuration. Where the transformer 88 has a unity turns ratio, the voltage across the flash tube 101 has a maximum possible value equal to four times the peak voltage of the source 12.

The transformer 88 is an inductive element and serves the function of the inductor 39 in the power supply 31. The capacitor 94 serves the function of the capacitor 43 in the power supply 31. The inductance of the transformer 88 and capacitance of the capacitor 94 are selected so that the power factor of the power supply 83 viewed from the source 12 is as close to unity as possible.

In summary, it will be seen that the present invention provides a power supply comprising novel and unique means for limiting surge current while simultaneously producing unity power factor. Various modifications will become possible for those skilled in the art after receiving the teachings of the present disclosure without departing from the scope thereof. For example, any number of rectifier-filter units may be connected together as long as the current limiting inductances and capacitors are selected so that the power factor is unity. It is also possible to select the values of the current limiting inductances and capacitances so that performance is optimized in the later low-gradient region of the charging curve 56 rather than in the earlier high-gradient portion thereof.

What is claimed is:

1. A power supply apparatus comprising:

a flash tube;

first rectifier means;

first smoothing filter means connected between an output of the first rectifier means and the flash tube;

second rectifier means;

second smoothing filter means connected between an output of the second rectifier means and the flash tube;

switch means for connecting the first and second rectifier means to an A.C. power source in a unitary manner;

sensor means for sensing a voltage across the flash tube and turning on the switch means when the sensed voltage is below a predetermined value and turning off the switch means when the sensed voltage is above a predetermined value;

a current limiting inductance means connected between the switch means and the first rectifier means;

a current limiting capacitance means connected between the switch means and the second rectifier means, an inductance of the inductance means and a capacitance of the capacitance means being selected in such a manner that a power factor of the power supply is substantially unity; and a transformer having a primary winding connected to the power source through the switch means, a first secondary winding connected to the first rectifier means through the inductance means and a second secondary winding connected to the second rectifier means through the capacitance means.

2. A power supply as in claim 1, in which the first and second filter means each comprise a capacitor.

3. A power supply as in claim 1, in which outputs of the first and second filter means are connected together in a voltage doubler configuration.

4. A power supply as in claim 1, in which outputs of the first and second filter means are connected together in a current doubler configuration.

5. A power supply as in claim 1, in which the switch means comprises a thyristor.

6. A power supply as in claim 1, in which the first and second rectifier means each comprise a full wave bridge rectifier.

* * * * *